US010767429B2

(12) United States Patent
McGuire et al.

(10) Patent No.: US 10,767,429 B2
(45) Date of Patent: Sep. 8, 2020

(54) PLUG BYPASS TOOL AND METHOD

(71) Applicants: Adam McGuire, Houston, TX (US); Matthew Stone, Humble, TX (US)

(72) Inventors: Adam McGuire, Houston, TX (US); Matthew Stone, Humble, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 79 days.

(21) Appl. No.: 16/109,531

(22) Filed: Aug. 22, 2018

(65) Prior Publication Data

US 2020/0063511 A1 Feb. 27, 2020

(51) Int. Cl.

| | |
|---|---|
| ***E21B 21/10*** | (2006.01) |
| ***E21B 34/14*** | (2006.01) |
| *E21B 33/12* | (2006.01) |

(52) U.S. Cl.

CPC ..... *E21B 21/103* (2013.01); *E21B 34/14* (2013.01); *E21B 33/12* (2013.01); *E21B 2200/06* (2020.05)

(58) Field of Classification Search

CPC ..... E21B 2034/002; E21B 2034/007; E21B 33/12; E21B 34/14; E21B 21/10; E21B 21/103

See application file for complete search history.

(56) References Cited

U.S. PATENT DOCUMENTS

| | | | | |
|---|---|---|---|---|
| 3,503,445 | A * | 3/1970 | Cochrum | E21B 33/127 166/244.1 |
| 3,746,092 | A * | 7/1973 | Land | E21B 43/103 166/207 |
| 6,702,020 | B2 * | 3/2004 | Zachman | E21B 43/045 166/278 |
| 7,954,555 | B2 * | 6/2011 | Ashy | E21B 21/103 166/318 |
| 8,555,983 | B2 * | 10/2013 | Palacios | E21B 23/04 166/316 |
| 2006/0219441 | A1 * | 10/2006 | Telfer | E21B 17/1078 175/325.7 |
| 2007/0295508 | A1 * | 12/2007 | Collins | E21B 43/006 166/308.1 |
| 2011/0114334 | A1 * | 5/2011 | Palacios | E21B 10/322 166/373 |
| 2011/0232969 | A1 * | 9/2011 | Laird | E21B 10/322 175/57 |
| 2012/0186816 | A1 * | 7/2012 | Dirksen | E21B 7/208 166/297 |
| 2012/0261136 | A1 * | 10/2012 | Ehtesham | E21B 34/14 166/373 |
| 2016/0168950 | A1 * | 6/2016 | Delgado | E21B 34/10 166/374 |
| 2018/0094508 | A1 * | 4/2018 | Smith | E21B 43/26 |

* cited by examiner

*Primary Examiner* — David Carroll
(74) *Attorney, Agent, or Firm* — Cantor Colburn LLP

(57) ABSTRACT

A plug bypass tool including a housing defining a main flow passage and a bypass passageway, the bypass passageway extending between a first port and a second port, the first and second ports being fluidly connected to the main flow passage, a first seat and a first sleeve disposed within the passage between the first port and second port, and a second seat and a second sleeve disposed in the passage, the second sleeve movable between a position covering the second port and a position revealing the second port.

18 Claims, 5 Drawing Sheets

PLUG BYPASS TOOL AND METHOD

BACKGROUND

In the resource recovery industry objects on seats are often used to create a plug whereby the application of pressure from a surface location or otherwise may be used for an operation such as to actuate a tool, fracture a formation, etc. Subsequent to the operation, removal of the object is often desired and there are many ways in which such removal may be addressed that are known to the art. Sometimes however, the speed at which fluid flow communication is reestablished is insufficient for an operator's needs. The art would well receive alternative means to restore fluid flow.

SUMMARY

A plug bypass tool including a housing defining a main flow passage and a bypass passageway, the bypass passageway extending between a first port and a second port, the first and second ports being fluidly connected to the main flow passage, a first seat and a first sleeve disposed within the passage between the first port and second port, and a second seat and a second sleeve disposed in the passage, the second sleeve movable between a position covering the second port and a position revealing the second port.

A method for bypassing a plug in a tool including landing a first object on a first seat, pressuring on the first object and moving a first sleeve, pressuring to perform an operation, landing a second object on a second seat, pressuring on the second object and moving a second sleeve, revealing a second port whereby a bypass passageway around the first object on the first seat is established.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
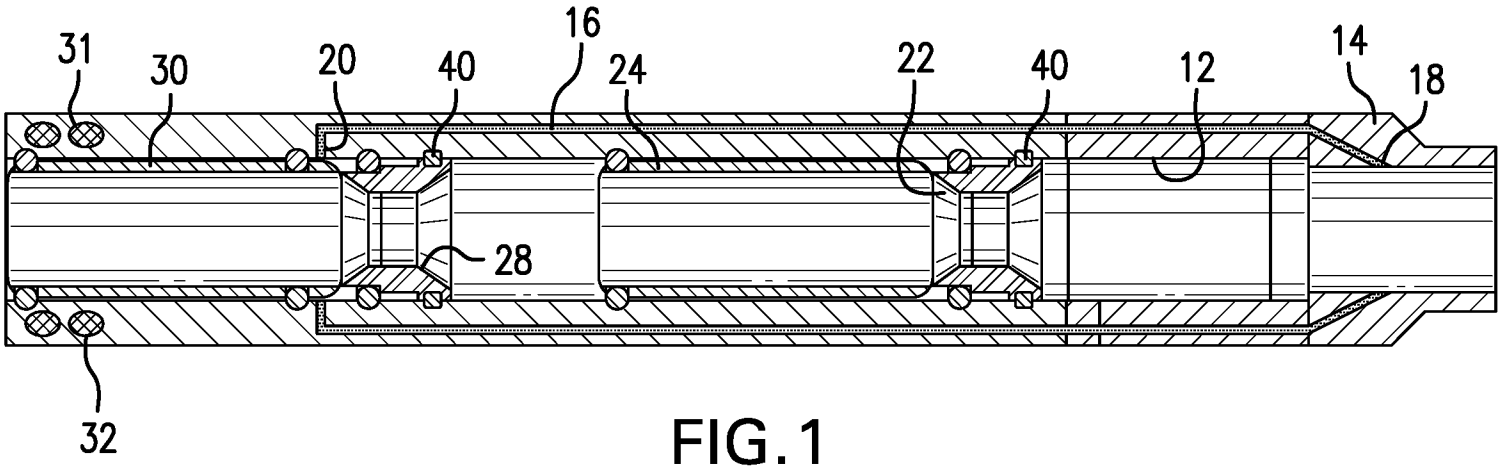
FIG. 1 is a cross sectional view of a tool as disclosed herein having a first seat and sleeve arrangement and a second seat and second sleeve arrangement in a run in condition.

Referring to FIG. 1 a plug bypass tool 10 facilitates early fluid flow around a plugged passage 12 such as a main flow bore of a tubular housing 14. The housing 14 includes a bypass passageway 16 that extends from a first port 18 to a second port 20 around a pluggable section of the tool 10. In an embodiment, a first seat 22 is operably connected to a first sleeve 24, the sleeve being positionable to cover or reveal fracture ports 26 in the housing 14 (visible in FIG. 2) but behind the first sleeve 24 in FIG. 1. A second seat 28 is operably connected to second sleeve 30 and is positionable to cover or reveal port 20, fracture ports 26 and production openings 31, optionally including filters 32. In the run in condition of the tool 10, first sleeve 24 covers fracture ports 26 and second sleeve 30 covers port 20 and production filters 32. This is easily seen to be the case in FIG. 1.

Figure 2:
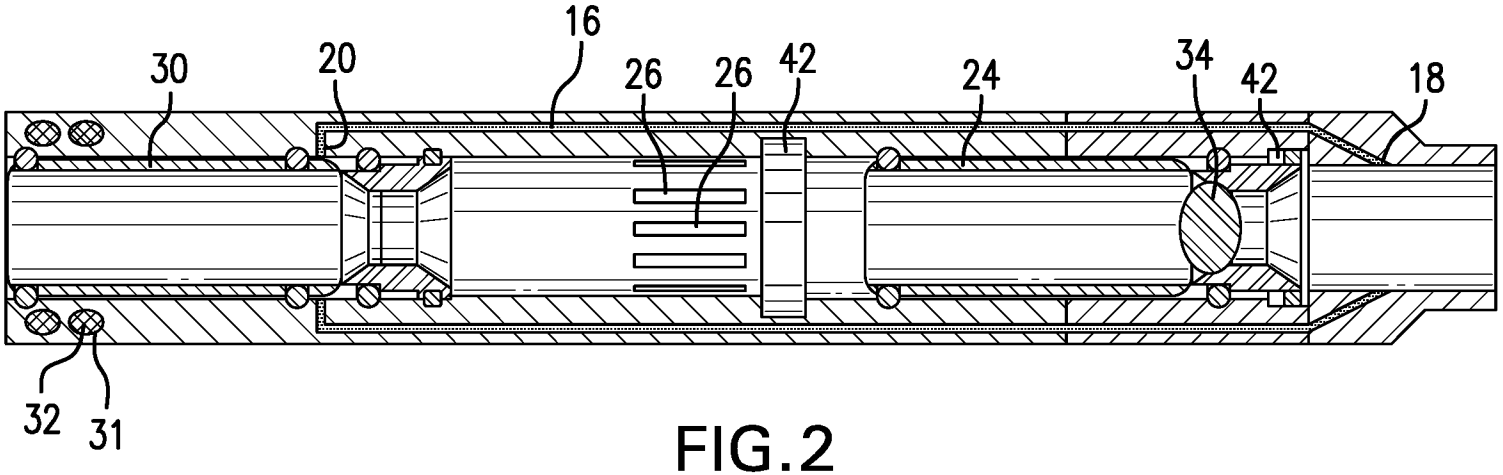
FIG. 2 is the tool of FIG. 1 with a first object landed on the first seat.
Figure 3:
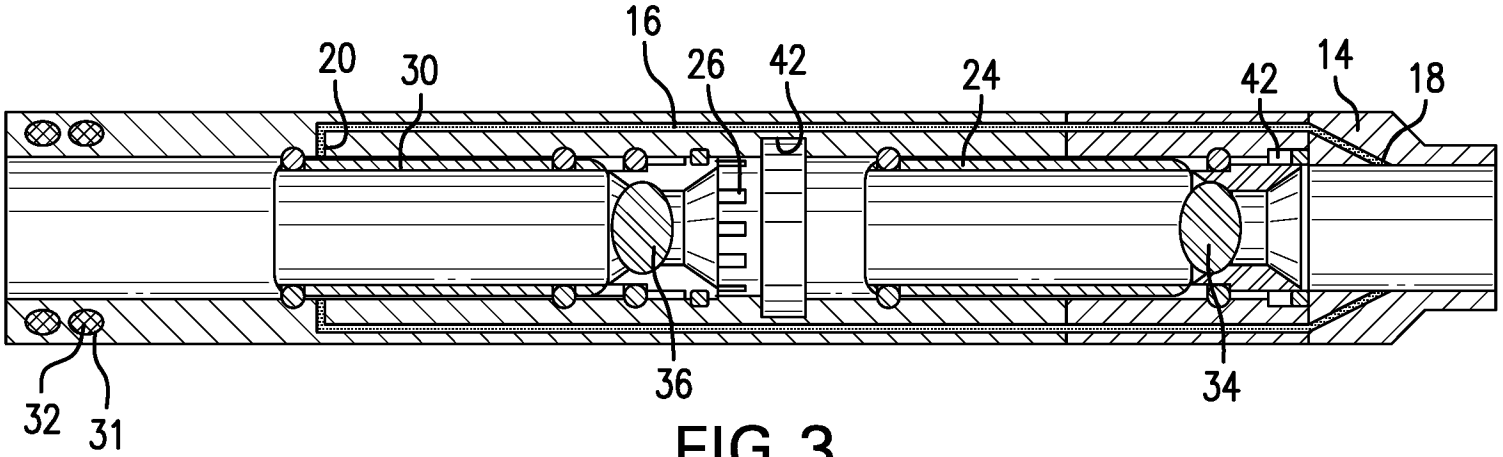
FIG. 3 is the tool of FIG. 1 with a second object landed on the second seat in a partially shifted position.
Figure 4:
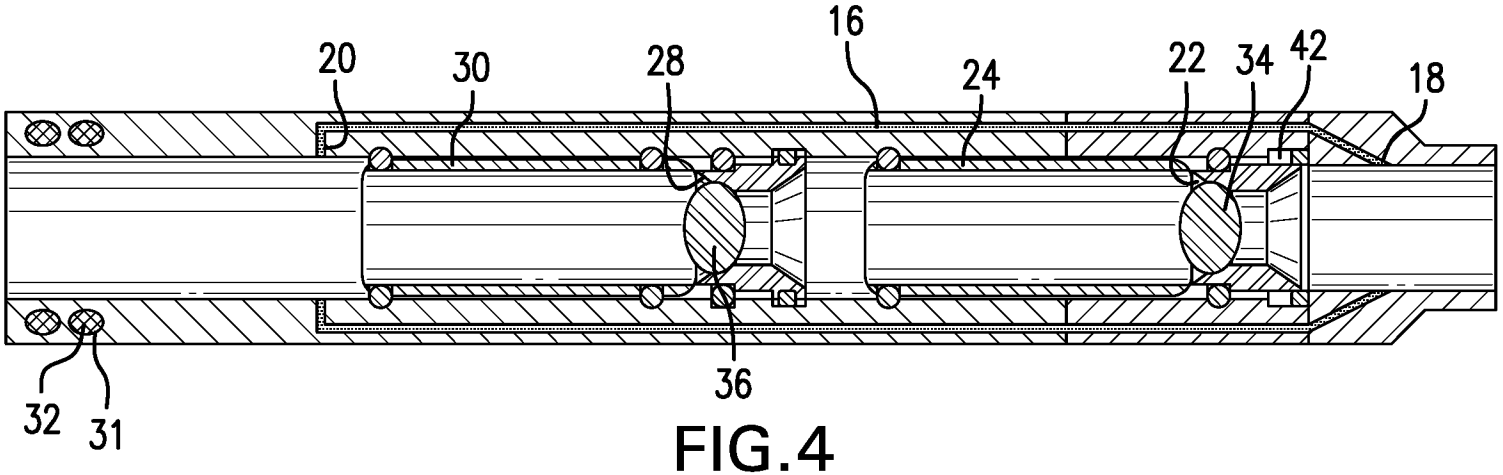
FIG. 4 is the tool of FIG. 1 wherein the second seat is fully shifted and a fluid bypass of the tool is enabled.

Referring to FIG. 2, the tool 10 has been shifted to a first operational position wherein an object 34 has landed on first seat 22 and pressure applied thereto causes the seat 22, object 34 and connected sleeve 24 to shift in a direction dictated by the pressure advance or in the drawing to the right, which is also intended to indicate a downhole direction for a subsurface borehole completion. The shifting of the sleeve 24 reveals the fracture ports 26 visible through the housing 14. In this condition, the tool 10 may be used by applying a fracture pressure against the object 34 and seat 22 to a level where a formation (not shown) will fracture in ways known to the downhole industry. Subsequent to the fracturing operation and as noted above it is often desirable to reestablish fluid flow through the housing 14. This can be accomplished by employing a degradable object 34 for example but may not occur as rapidly as desired. Accordingly, tool 10 also supplies bypass passageway(s) 16 that extend from first port 18 downhole of the object 34 and seat 22 to a second port 20 uphole of the object 34 and seat 22. This port 20 as is evident in FIG. 2 is covered by second sleeve 30. The second seat 28 is, however, available to accept a second object 36, which can be seen in FIG. 3. The FIG. 3 view is taken after the second object 36 has landed in second seat 28 and sufficient pressure has been applied to the combination of object 36 and seat 28 to cause movement of second sleeve 30. As illustrated, the sleeve 30 has partially covered fracture ports 26 that had been uncovered by first sleeve 24 in the first pressure operation. Movement of second sleeve 30 will continue based upon the applied pressure from uphole of object 34, displacing otherwise trapped fluid between first object 34 and second object 36 through the fracture ports 26. As the sleeve 30 completes its movement to cover fracture ports 26, the port 20 is opened, which condition may be seen in FIG. 4. It will also be appreciated in FIG. 4 that both port 18 and port 20 are open the main flow bore 12 and to bypass passageway 16. Because the ports 18 and 20 straddle the objects in their respective seats, flow around the objects is possible.

The bypass passageway(s) 16 may be created through gun drilling processes or may be a product of the housing 14 being created additively in an additive manufacturing operation and defining the bypass passageway(s) 16 in that operation.

In embodiments, it may be desirable to configure the first and or second sleeves 24 and 30 with automatic retainers 40 such as C rings that automatically engage grooves 42 in housing 14 so that the sleeves 24 and/or 30 do not shift again after the retainers 40 engage the respective grooves 42. Engagement is to occur when the sleeves 24 and or 30 reach their downholemost intended locations.

Figure 5:
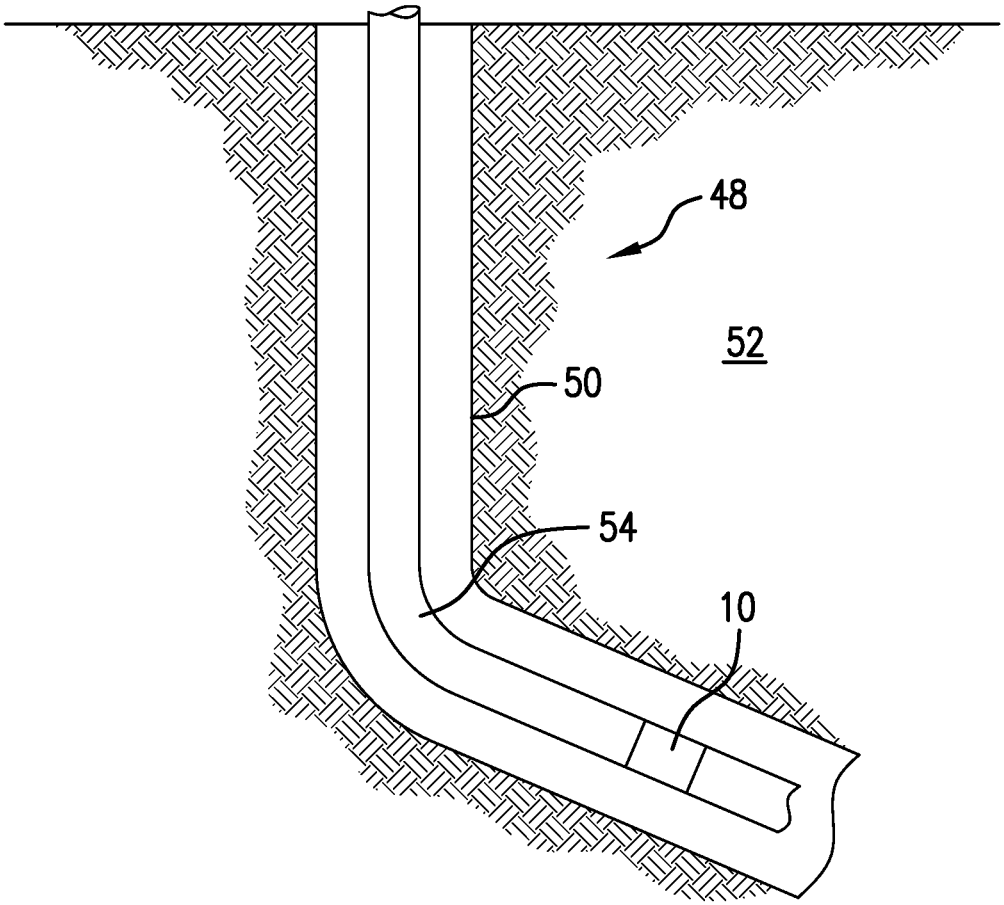
FIG. 5 is a schematic view of a wellbore system including the tool of FIG. 1.

In an iteration of the foregoing, referring to FIG. 5, the tool 10 forms a part of a wellbore system 48 comprising a borehole 50 in a formation 52; drilling or completion string 54 disposed within the borehole 50 and the tool 10 being a part of the drilling or completion string 54.

A method for bypassing a plug in a tool comprises landing a first object 34 on a first seat 22, pressuring against the first object 34 to move a first sleeve 24 connected to the first seat 22 sufficiently to reveal a fracture port 26. Applying a higher pressure sufficient to fracture the formation 52 outside of the tool 10. Landing a second object 36 on a second seat 28 and pressuring against the second object 36 to move a second sleeve 30 to cover the ports 26 and reveal one or more of the filters 32 and the port 20 thereby creating a bypass flow path around the objects 34 and 36.

Set forth below are some embodiments of the foregoing disclosure:

Embodiment 1: A plug bypass tool including a housing defining a main flow passage and a bypass passageway, the bypass passageway extending between a first port and a second port, the first and second ports being fluidly connected to the main flow passage, a first seat and a first sleeve disposed within the passage between the first port and second port, and a second seat and a second sleeve disposed in the passage, the second sleeve movable between a position covering the second port and a position revealing the second port.

Embodiment 2: The plug bypass tool as in any prior embodiment wherein the housing includes a fracture port.

Embodiment 3: The plug bypass tool as in any prior embodiment wherein the first sleeve is moveable between a position covering the fracture port and a position revealing the fracture port.

Embodiment 4: The plug bypass tool as in any prior embodiment wherein the first seat and first sleeve are responsive to a first object landable on the first seat.

Embodiment 5: The plug bypass tool as in any prior embodiment wherein the second sleeve when in a position to reveal the second port covers the fracture port.

Embodiment 6: The plug bypass tool as in any prior embodiment wherein the passageway is a gun drilled configuration.

Embodiment 7: The plug bypass tool as in any prior embodiment wherein the first sleeve includes an automatic retainer.

Embodiment 8: The plug bypass tool as in any prior embodiment wherein the automatic retainer is a C ring.

Embodiment 9: The plug bypass tool as in any prior embodiment wherein the second sleeve includes an automatic retainer.

Embodiment 10: The plug bypass tool as in any prior embodiment wherein the automatic retainer is a C ring.

Embodiment 11: The plug bypass tool as in any prior embodiment wherein the housing includes a production opening.

Embodiment 12: The plug bypass tool as in any prior embodiment wherein the production opening includes a filter.

Embodiment 13: A method for making a plug bypass tool comprising depositing material in accordance with a program to layer by layer build the housing as in any prior embodiment.

Embodiment 14: The method for making a plug bypass tool as in any prior embodiment further comprising building the entire tool as in any prior embodiment.

Embodiment 15: A wellbore system including a borehole in a formation, a string disposed within the borehole, and a tool as in any prior embodiment making up a part of the string.

Embodiment 16: A method for bypassing a plug in a tool including landing a first object on a first seat, pressuring on the first object and moving a first sleeve, pressuring to perform an operation, landing a second object on a second seat, pressuring on the second object and moving a second sleeve, revealing a second port whereby a bypass passageway around the first object on the first seat is established.

Embodiment 17: The method as in any prior embodiment wherein the operation is a fracture operation.

Embodiment 18: The method as in any prior embodiment wherein moving the first sleeve is revealing a fracture port.

Embodiment 19: The method as in any prior embodiment further comprising flowing fluid through the established bypass passageway.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A plug bypass tool comprising:

a housing defining a main flow passage and a bypass passageway, the bypass passageway extending between a first port and a second port, the first and second ports being fluidly connected to the main flow passage, the housing further including a fracture port between the first and second ports;

a first seat and a first sleeve disposed within the passage between the first port and second port; and a second seat and a second sleeve disposed in the passage, the second sleeve movable between a position covering the second port and a position revealing the second port.

2. The plug bypass tool as claimed in claim 1 wherein the first sleeve is moveable between a position covering the fracture port and a position revealing the fracture port.

3. The plug bypass tool as claimed in claim 1 wherein the first seat and first sleeve are responsive to a first object landable on the first seat.

4. The plug bypass tool as claimed in claim 1 wherein the second sleeve when in a position to reveal the second port covers the fracture port.

5. The plug bypass tool as claimed in claim 1 wherein the passageway is a gun drilled configuration.

6. The plug bypass tool as claimed in claim 1 wherein the first sleeve includes an automatic retainer.

7. The plug bypass tool as claimed in claim 6 wherein the automatic retainer is a C ring.

8. The plug bypass tool as claimed in claim 1 wherein the second sleeve includes an automatic retainer.

9. The plug bypass tool as claimed in claim 8 wherein the automatic retainer is a C ring.

10. The plug bypass tool as claimed in claim 1 wherein the housing includes a production opening.

11. The plug bypass tool as claimed in claim 10 wherein the production opening includes a filter.

12. A method for making a plug bypass tool comprising depositing material in accordance with a program to layer by layer build the housing as claimed in claim 1.

13. The method for making a plug bypass tool as claimed in claim 12 further comprising building the entire tool as claimed in claim 1.

14. A wellbore system comprising:

a borehole in a formation;

a string disposed within the borehole; and a tool as claimed in claim 1 making up a part of the string.

15. A method for bypassing a plug in a tool as claimed in claim 1, the method comprising:

landing a first object on the first seat;

pressuring on the first object and moving the first sleeve;

pressuring to perform an operation;

landing a second object on the second seat;

pressuring on the second object and moving the second sleeve;

revealing the second port whereby the bypass passageway around the first object on the first seat is established.

16. The method as claimed in claim 15 wherein the operation is a fracture operation.

17. The method as claimed in claim 15 wherein moving the first sleeve is revealing a fracture port.

18. The method as claimed in claim 15 further comprising flowing fluid through the established bypass passageway.

* * * * *